US007929885B2

(12) United States Patent
Sakuma

(10) Patent No.: US 7,929,885 B2
(45) Date of Patent: Apr. 19, 2011

(54) IMAGE FORMATION APPARATUS WITH DEVELOPER STORAGE MEMBERS

(75) Inventor: Susumu Sakuma, Kasugai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 17 days.

(21) Appl. No.: 12/342,481

(22) Filed: Dec. 23, 2008

(65) Prior Publication Data

US 2009/0162096 A1 Jun. 25, 2009

(30) Foreign Application Priority Data

Dec. 25, 2007 (JP) ..... 2007-333254

(51) Int. Cl.
*G03G 15/08* (2006.01)

(52) U.S. Cl. ..... 399/258; 399/107; 399/262

(58) Field of Classification Search ..... 399/258, 399/262, 107

See application file for complete search history.

(56) References Cited

U.S. PATENT DOCUMENTS 7,076,192 B2 7/2006 Tsuda et al.
2006/0285885 A1* 12/2006 Lee ..... 399/262

FOREIGN PATENT DOCUMENTS

JP 2000-314997 11/2000
JP 2004-220012 8/2004
JP 2005-316190 11/2005

* cited by examiner

*Primary Examiner* — Hoang Ngo
(74) *Attorney, Agent, or Firm* — Banner & Witcoff, Ltd.

(57) ABSTRACT

An image formation apparatus includes: a casing defining a first direction, a second direction perpendicular to the first direction and a third direction perpendicular to both the first and second directions; and first and second developer storage members, each having an developer supply port. The first and second developer storage members are disposed in the casing to be juxtaposed substantially in the first direction and to elongate in the second direction so that the developer supply ports of the first and second developer storage members are offset in the second direction.

20 Claims, 6 Drawing Sheets

IMAGE FORMATION APPARATUS WITH DEVELOPER STORAGE MEMBERS

CROSS REFERENCE TO RELATED APPLICATION

The present disclosure relates to the subject matter contained in Japanese patent application No. 2007-333254 filed on Dec. 25, 2007, which is expressly incorporated herein by reference in its entirety.

TECHNICAL FIELD

This invention relates to an image formation apparatus including and/or mountable thereto a plurality of developer storage members.

BACKGROUND ART

For example, Japanese Patent Publication 2004-220012A discloses an image formation apparatus, in which a plurality of toner bottles (developer storage members) are placed in a horizontal direction such that an opening of each toner bottles is located at a lower part of the toner bottle and directed downward (see FIG. 1 of the publication). Because the opening of each toner bottle is located at the lower part and directed downward, the developer stored in the toner bottle can be supplied well from the opening.

In case where an image formation apparatus is designed such that developer storage members are juxtaposed in a substantially vertical direction and an opening of each developer storage member is located at a lower part thereof and directed downward, the developer storage members need to be spaced away from each other in the vertical (up and down) direction. Otherwise, a conveying passage for conveying a developer from the opening of an upper developer storage member interferes with an adjacent lower developer storage member. On the other hand, if the developer storage members are spaced away from each other in the up and down direction, the image formation apparatus becomes larger in size in the up and down direction and a space above the image formation apparatus can not be used effectively.

SUMMARY

Under these circumstances, the present invention can provide, as one of illustrative, non-limiting embodiment, an image formation apparatus including: a casing defining a first direction, a second direction perpendicular to the first direction and a third direction perpendicular to both the first and second directions; and first and second developer storage members, each having an developer supply port. The first and second developer storage members are disposed in the casing to be juxtaposed substantially in the first direction and to elongate in the second direction so that the developer supply ports of the first and second developer storage members are offset in the second direction.

Accordingly, as one of advantages, the invention can provide an image formation apparatus small in size in a first direction. As another one of the advantages, the present invention can provide an image formation apparatus that enables effective use of a space of the apparatus in the first direction. As yet another one of the advantages, the present invention can provide an image formation apparatus that enables desired, excellent developer supply from each developer storage member. As still another one of the advantages, the present invention can provide an image formation apparatus that can suppress upsizing of the apparatus in a second and/or third direction, in particular, in a third direction of the developer storage member.

These and other advantages of the present invention will be discussed in detail with reference to the accompanying drawings.

DESCRIPTION OF THE PREFERRED EMBODIMENT

Referring now to the accompanying drawings, illustrative, non-limiting embodiments of the invention will be discussed in detail. In the accompanying drawings, FIG. 1 is a sectional view to show the schematic configuration of a color laser printer as an example of an image formation apparatus, and FIG. 2 is a perspective view of the color laser printer.

In the description to follow, the directions are defined based on a user using the color laser printer. That is, in FIG. 1, the left of the plane of the figure is "front," the right of the plane of the figure is "back," the back of the plane of the figure is "left," and the front of the plane of the figure is "right." The up and down direction of the plane of the figure is "up and down direction." The "front" refers to the side for the user to operate the color laser printer. The use of these terms is intended to facilitate understanding of the structure of the color laser printer, and should not be interpreted in a restrictive sense.

Figure 1:
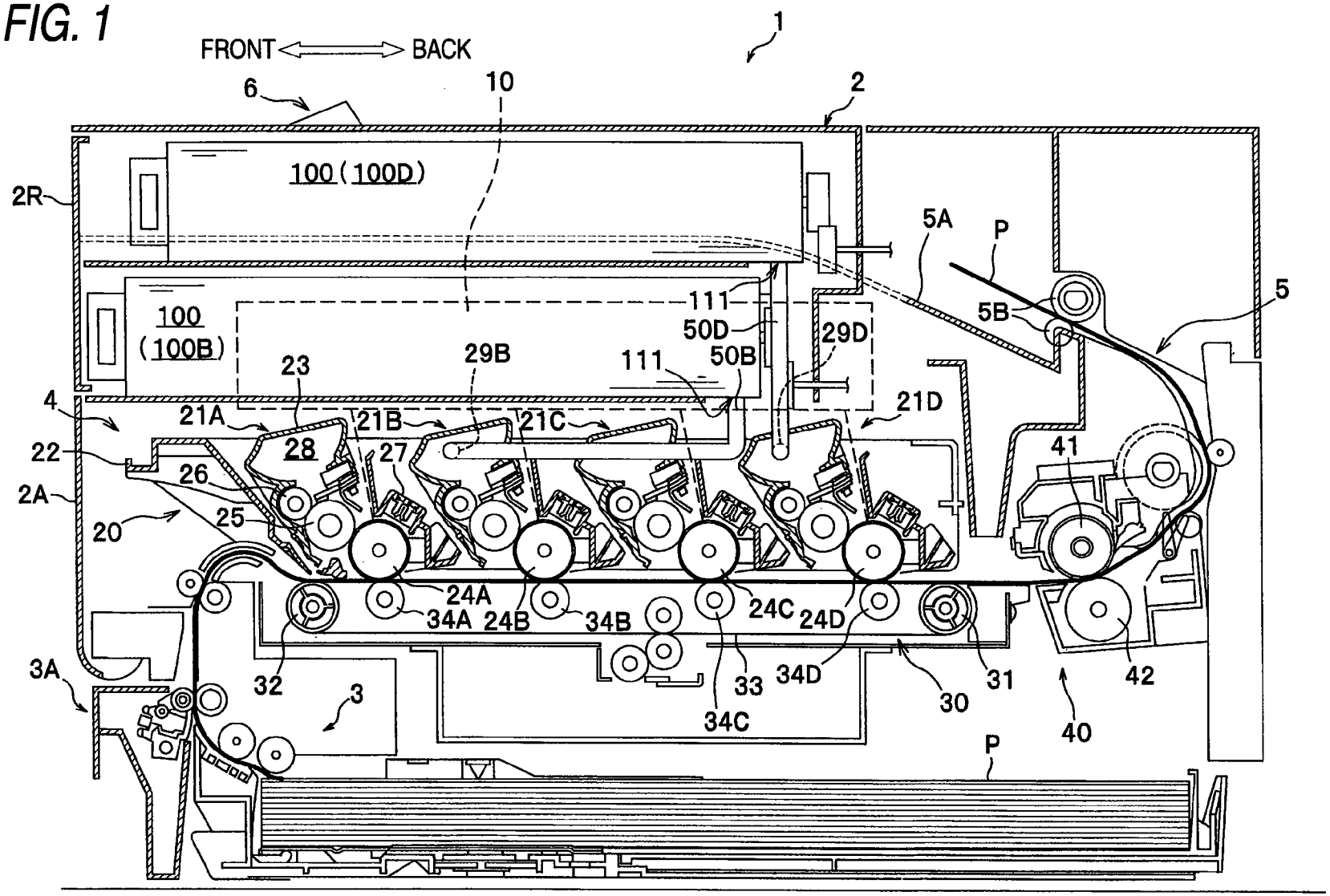
FIG. 1 is a sectional view to show the schematic configuration of a color laser printer as an example of an image formation apparatus.

A color laser printer 1 includes, a main body casing 2, a sheet feed unit 3 for feeding a sheet P as an example of a record sheet, an image forming unit 4 for forming an image on the fed sheet P, a sheet discharge unit 5 for discharging the sheet P with the image formed thereon, and four toner cartridges 100 (100A to 100D; see FIG. 2) as an example of a plurality of developer storage members capable of storing toners (developers) used for image formation, as shown in FIG. 1. The units 3, 4 and 5 and the cartridges 100 are provided within the casing 2.

Figure 2:
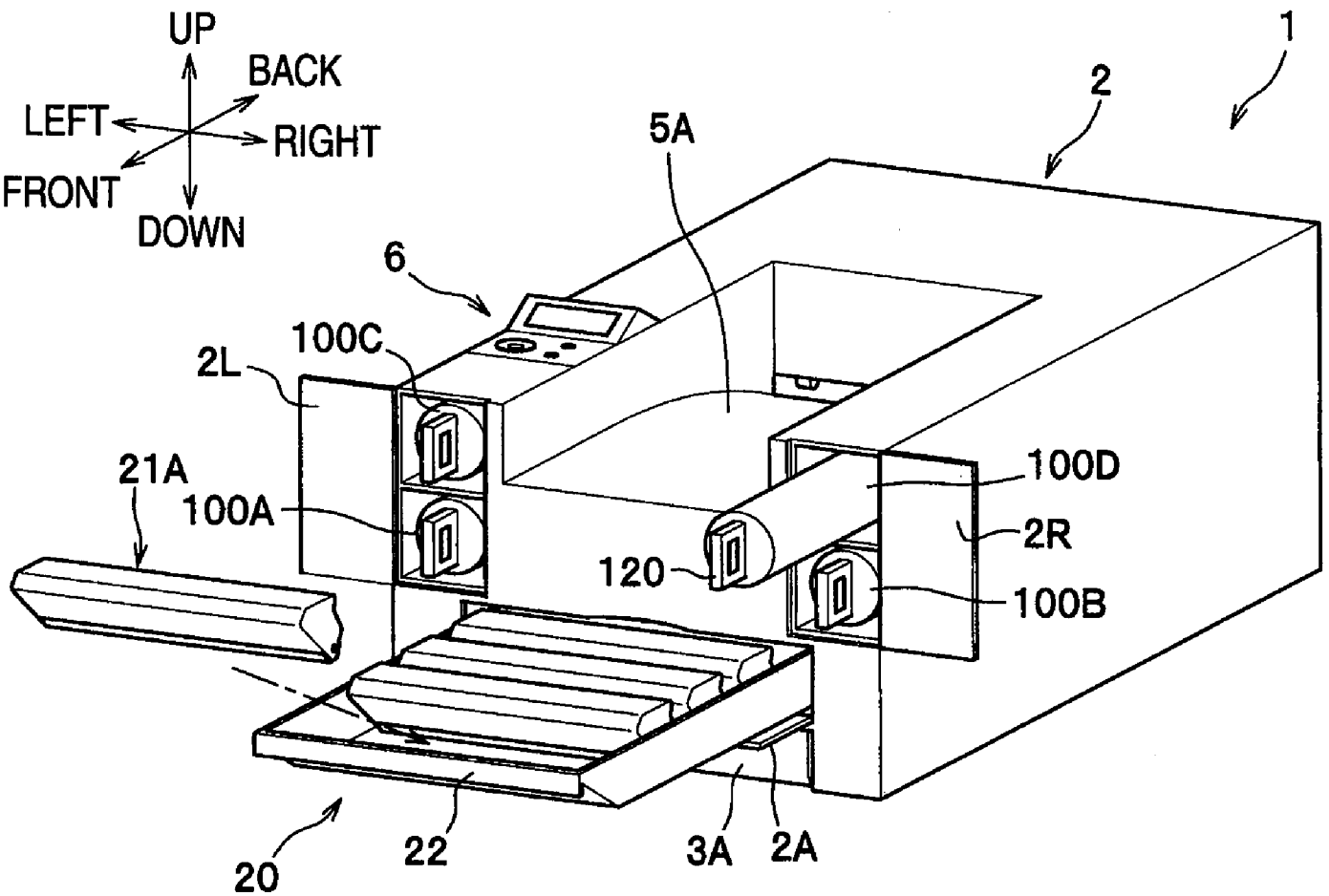
FIG. 2 is a perspective view of the color laser printer.

An operation unit 6 that can be operated by the user from the front of one of the sides of the main body casing 2 is provided on the front left of the top face of the main body casing 2, as shown in FIG. 2. A front cover 2A that can be opened and closed is provided rotatably in the front and back direction (which will be hereinafter referred to as the back and forth direction) on the front of the main body casing 2. An opening made when the front cover 2A is opened allows the user to draw out a frame 22 toward the front. The frame 22 supports process cartridges 21 (21A to 21D) described later. A sheet discharge tray 5A as an example of a record sheet discharge unit for storing the sheets P discharged from the main body casing 2 is provided in the top part of the main body casing 2, as shown in FIG. 1.

The sheet feed unit 3 diverts the sheet P, stored in a sheet feed cassette 3A provided at the bottom of the main body casing 2, from the front to the back by various rollers, while conveying the sheet to a conveying belt 33. The sheet feed cassette 3A is detachably placed in the main body casing 2.

The image forming unit 4 is mainly made up of an exposure unit 10, a developing unit 20, a transfer unit 30, and a fixing unit 40.

The exposure unit 10 is provided in an upper part of the main body casing 2 and mainly includes a laser emission unit, a polygon mirror, a plurality of lenses, and a plurality of reflecting mirrors (not shown). The dimension of the exposure unit 10 in a direction orthogonal to the conveying direction of the sheet P, namely, the left-right dimension of the exposure unit 10 is smaller than the left-right dimension of the developing unit 20 (frame 22) described later. (See FIG. 4.) The exposure unit 10 scans laser light emitted from the laser emission unit corresponding to each color of cyan, magenta, yellow, and black at high speed in the left-right direction with the polygon mirror, allows the laser light to pass through the lenses, and reflects the laser light on the reflecting mirrors and then applies the laser light to photosensitive drums 24 (24A to 24D) as an example of photosensitive members.

The developing unit 20 is provided below the exposure unit 10 in the main body casing 2 and mainly includes the above-mentioned four process cartridges 21 (21A to 21D) and the frame 22 for supporting the four process cartridges 21 so that the four process cartridges 21 are placed side by side in the conveying direction of the sheet P, namely, in the back and forth direction and. Each of the process cartridges 21 is detachably mounted to the frame 22 and can be replaced in a state in which the frame 22 is drawn out to the front of the main body casing 2.

The process cartridge 21 mainly includes a cartridge frame 23, and the above-mentioned photosensitive drum 24 (photosensitive member), a developing roller 25 and a supply roller 26, which are rotatably supported on the cartridge frame 23. The process cartridge 21 further includes a scorotron type charger 27, and a toner storage chamber 28 for storing toner supplied from the toner cartridge 100 described later, as shown in FIG. 1. Each cartridge frame 23 is provided, on a side (left side or right side) thereof, with a replenishment port 29 for replenishing the toner storage chamber 28 with toner supplied from the corresponding toner cartridge 100 (replenishment ports 29B and 29D shown in FIG. 1). The process cartridges 21 have the same configuration with the exception of the color of the toner supplied to the toner storage chamber 28 (cyan, magenta, yellow, or black) and the position where the replenishment port 29 is formed.

The transfer unit 30 is provided between the sheet feed unit 3 and the developing unit 20 in the main body casing 2 and mainly includes a drive roller 31, a driven roller 32, the above-mentioned conveying belt 33, and four transfer rollers 34 (34A to 34D). The drive roller 31 and the driven roller 32 are placed in parallel away from each other in the back and forth direction, and the conveying belt 33 in the form of an endless belt is suspended between the drive roller 31 and the driven roller 32. The conveying belt 33 has the outer side in contact with the photosensitive drums 24 and the inner side in contact with the transfer rollers 34. The photosensitive drums 24 and the transfer rollers 34 are opposed to each other so as to sandwich the conveying belt 33 therebetween. A transfer bias is applied to the transfer roller 34 under constant current control during image transfer.

The fixing unit 40 is provided at the back of the developing unit 20 and the transfer unit 30 in the main body casing 2, and mainly includes a heating roller 41 and a pressing roller 42 opposed to the heating roller 41 for pressing the heating roller 41.

The image forming unit 4 thus constructed functions as follows: The surfaces of the photosensitive drums 24 are uniformly charged by the scorotron type chargers 27 and then are exposed to the laser light applied from the exposure unit 10. Accordingly, the potential of the exposed portion lowers and an electrostatic latent image based on image data is formed on the surface of each photosensitive drum 24. The toner in the toner storage chamber 28 is supplied to the developing roller 25 through the supply roller 26 and is carried on the developing roller 25.

When the developing roller 25 is opposed to the photosensitive drum 24 and comes in contact therewith, the toner carried on the developing roller 25 is supplied to the electrostatic latent image formed on the surface of the photosensitive drum 24. Accordingly, the toner is selectively carried on the surface of the photosensitive drum 24 to render the electrostatic latent image visible to form a toner image. The sheet P fed to the conveying belt 33 passes through between each photosensitive drum 24 and each transfer roller 34 placed on the inner side of the conveying belt 33, whereby the toner images formed on the surfaces of the photosensitive drums 24 are transferred onto the sheet P sequentially in an overlap manner.

The sheet P with the toner image transferred thereonto passes through the nip between the heating roller 41 and the pressing roller 42, whereby the toner is thermally fixed. The sheet P with the toner image thermally fixed is conveyed from the fixing unit 40 to the sheet discharge unit 5 and is discharged to the outside of the main body casing 2 by a conveying roller 5B for storage in the sheet discharge tray 5A.

Figure 3:
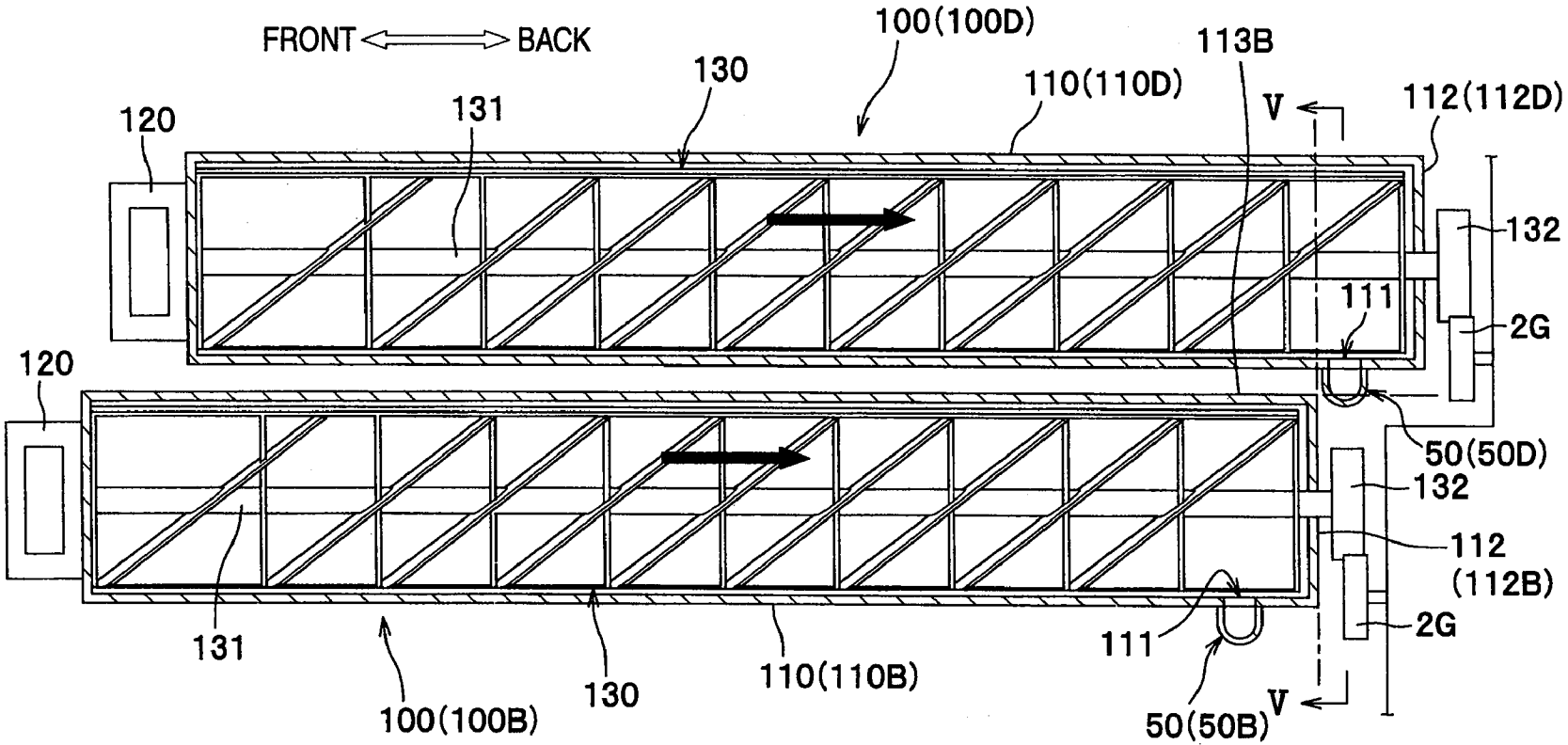
FIG. 3 is a sectional view to show the configuration of toner cartridges placed in a main body casing.
Figure 4:
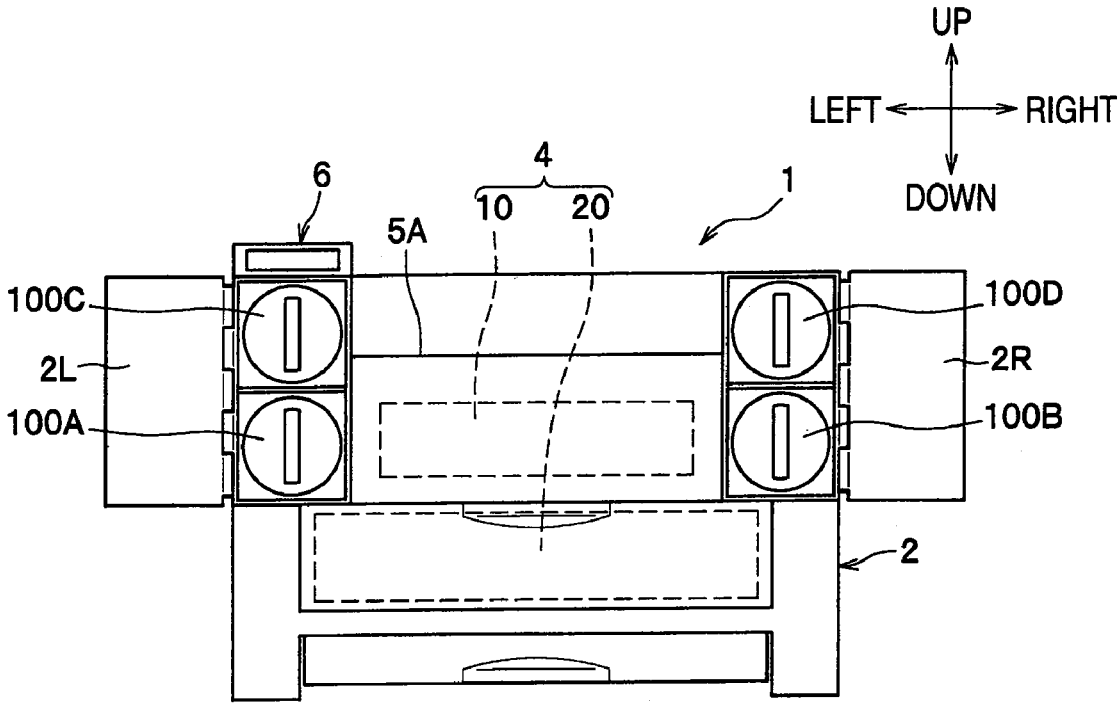
FIG. 4 is a front view of the color laser printer to describe the placement of the toner cartridges.

Next, the configuration and placement of the toner cartridges 100, which is one of features of the invention, will be discussed in detail. FIG. 3 is a sectional view to show the configuration of the toner cartridges placed in the main body casing, and FIG. 4 is a front view of the color laser printer to describe the placement of the toner cartridges.

In the description to follow, when the four toner cartridges need not be specifically distinguished from each other, they are collectively referred to as the toner cartridge 100, and when it is better to distinguish the four toner cartridges from each other, they are referred to as the toner cartridges 100A to 100D.

The toner cartridge 100 mainly includes a cartridge casing 110 having a substantially cylindrical shape (see FIG. 2) for storing toner therein, as shown in FIG. 3. The toner cartridge 100 further includes a supply port 111 that is located at the back of the cartridge housing 110 and directed downward at the lower side of the cartridge housing 110 when the toner cartridge 100 is mounted in place to the main body casing 2. The cartridge casing 110 is formed, at the front thereof, with a handle 120 as an example of a gripper that can be gripped when the toner cartridge 100 is to be attached or detached.

The toner cartridge 100 further includes an agitator 130 as an example of a conveying member inside the cartridge casing 110. The agitator 130 is rotated coaxially to a rotation shaft 131 to convey toner from the front to the back, namely, toward the supply port 111 while agitating the toner.

The rotation shaft 131 projects from a back wall face 112 of the cartridge casing 110, and a drive gear 132 as an example of a drive input part is fixed to an end of the rotation shaft 131. The drive gear 132 meshes with a transmission gear 2G provided in the main body casing 2. A drive force is transmitted from a drive source, such as a motor (not shown) provided in the main body casing 2, through the transmission gear 2G to the drive gear 132 for rotating the rotation shaft 131 and the agitator 130.

The toner cartridges 100A to 100D are placed two on each side in the main body casing 2 such that the image forming unit 4 is located between the toner cartridges 100A to 100D as shown in FIG. 4. Specifically, the toner cartridges 100A and 100C are placed on the left side and the toner cartridges 100B and 100D are placed on the right side such that the exposure unit 10 having the left-right dimension smaller than the developing unit 20 (frame 22) is located between the left toner cartridges 100A, 100C and the right toner cartridges 100B, 100D.

The two toner cartridges 100B and 100D (or 100A and 100C) on each side are juxtaposed substantially in the vertical direction. More particularly, the two toner cartridges 100B and 100D (or 100A and 100C) are placed not to overlap when viewed from the left-right direction (horizontal direction), namely, the whole of the toner cartridge 100D (or 100C) is placed above the whole of the toner cartridge 100B (or 100A).

The expression "juxtaposed substantially in the vertical direction" is intended to encompass, for example, a case in which a plane S (see FIG. 5) defined by the vertical direction and the length direction of the toner cartridge 100 passes through the supply port 111 of the upper toner cartridge 100D of the two toner cartridges 100B and 100D adjacent to each other up and down and also passes through the lower toner cartridge 100B.

The upper toner cartridge 100D (or 100C) and the lower toner cartridge 100B (or 100A) are offset from each other in the back and forth direction (or the length direction of the toner cartridge 100). Specifically, as shown in FIG. 3, the toner cartridges 100D and 100B are disposed so that the rear end of the upper toner cartridge 100D (or 100C) is at a backmore position than the rear end of the lower toner cartridge 100B (or 100A). Accordingly, the supply ports 111 of the toner cartridges 100B and 100D (or 100A and 100C) juxtaposed substantially in the vertical direction are also offset from each other in the back and forth direction (or the length direction of the toner cartridge 100).

The toner cartridges 100B and 100D (or 100A and 100C) juxtaposed substantially in the vertical direction are disposed to overlap the image forming unit 4 when viewed from the left-right direction (horizontal direction), as shown in FIG. 4. More particularly, the upper toner cartridge 100D (or 100C) is disposed to overlap the sheet discharge tray 5A when viewed from the left-right direction, and the lower toner cartridge 100B (or 100A) is disposed to overlap the exposure unit 10 when viewed from the left-right direction.

The toner cartridges 100A to 100D are detachably mountable at the front side of the main body casing 2 as shown in FIG. 2. Specifically, a user can open the openable/closable toner cartridge cover 2R, 2L on the front of the main body casing 2 to provide an opening and then detach any of the toner cartridges 100A to 100D by drawing out the toner cartridge toward the front through the opening with the handle 120. Similarly, the user can attach the toner cartridge by pushing the toner cartridge into the back through the opening. This way, the user can replace the toner cartridges 100A to 100D at the front of the main body casing 2. The attachment/detachment passages of the toner cartridges 100A to 100D completely deviate from the attachment/detachment passage of the developing unit 20 (frame 22). That is, the attachment/detachment passages of the toner cartridges 100A to 100D do not overlap the attachment/detachment passage of the developing unit 20 (frame 22) when viewed from the front.

The toner cartridges 100A to 100D are attached to and detached from the main body casing 2 in the length direction of the toner cartridges 100A to 100D and disposed to elongate in the back and forth direction, i.e. a direction in which the photosensitive drums 24 (process cartridges 21) are arrayed (see FIG. 1). More particularly, the toner cartridge 100 is disposed so that the length direction of the cartridge casing 110 corresponds to the attachment/detachment direction of the toner cartridge 100. The toner cartridge 100 is disposed in the main body casing 2 in a state in which the toner cartridge 100 like a cylinder lies down substantially horizontally. A direction, in which the rotation shaft 131 (see FIG. 3) of the agitator 130 extends, is coincident with the length direction of the toner cartridge 100.

Figure 5:
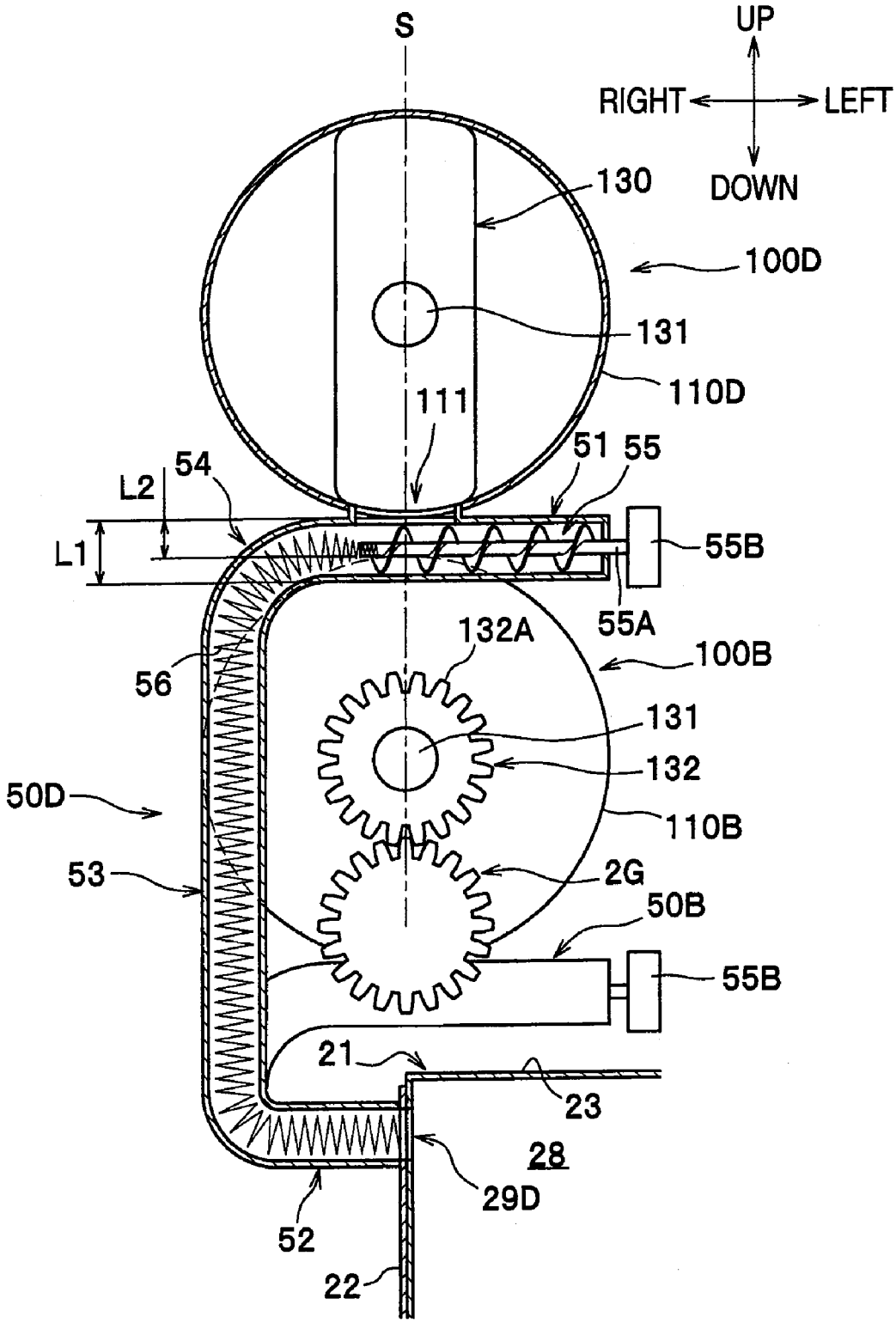
FIG. 5 is a sectional view taken on line V-V in FIG. 3.

A mechanism for conveying the toner stored in the toner cartridge 100 to the toner storage chamber 28 of the process cartridge 21 will be discussed. FIG. 5 is a sectional view taken on line V-V in FIG. 3.

As shown in FIG. 1, four conveying passages 50 (50A to 50D) for conveying the toner stored in the toner cartridges 100 (100A to 100D) to the toner storage chambers 28 of the process cartridges 21 (21A to 21D) are provided in the main body casing 2 (the conveying passages 50A and 50C are not shown). As shown in FIGS. 1 and 5, the conveying passage 50 has one end joined detachably to the lower side face of the back of the toner cartridge 100 and an opposite end joined detachably to the side face of the process cartridge 21 (toner storage chamber 28) through the side face of the frame 22. The conveying passage 50 allows the supply port 111 of the toner cartridge 100 and the replenishment port 29 of the process cartridge 21 to communicate with each other. In the embodiment, the replenishment port 29 is located lower in a gravity direction than the supply port 111 communicating with the replenishment port 29 through the conveying passage 50.

The conveying passage 50 extends to avoid interference with the drive gear 132, the transmission gear 2G, etc., located below the supply port 111 as shown in FIG. 5. Taking the conveying passage 50D for conveying toner from the toner cartridge 100D shown in FIG. 5 as an example for the description, the conveying passage 50D includes a first horizontal section 51 joined to the toner cartridge 100D and extending in the left-right direction, a second horizontal section 52 joined to the frame 22 and extending in the left-right direction, and a vertical section 53 extending upward in the vertical direction from the top of one end of the second horizontal section 52, and a bend section 54 for connecting the first horizontal section 51 and the vertical section 53.

Since the conveying passage 50D is placed at the back of the toner cartridge 100B (see FIG. 1), the first horizontal section 51 and the vertical section 53 overlap the toner cartridge 100B when viewed from the back and forth direction (the attachment/detachment direction of the toner cartridge 100) as shown in FIG. 5.

An auger 55 in the first horizontal section 51 rotated on a rotation shift 55A, thereby conveying toner from the left to the right. The rotation shift 55A has one end projecting from the left wall face of the first horizontal section 51, and a drive gear 55B is fixed to the one end. The drive gear 55B meshes with a transmission gear (not shown) provided in the main body casing 2 and a drive force is transmitted through the transmission gear from a drive source of a motor (not shown) provided in the main body casing 2 for rotating the rotation shift 55A and the auger 55.

A spring auger 56 shaped like a coil spring is provided in the second horizontal section 52, the vertical section 53, and the bend section 54. The spring auger 56 has one end fixed to an opposite end of the rotation shift 55A of the auger 55 to be rotated by rotation of the rotation shift 55A.

With the conveying passage 50D thus constructed, toner is first supplied from the toner cartridge 100D (cartridge casing 110D) through the supply port 111 to the first horizontal section 51 and is conveyed to the right by the auger 55. Next, the toner is conveyed downward in the bend section 54 and the vertical section 53 by gravity and the spring auger 56, is pushed out to the left in the second horizontal section 52, and is supplied through the replenishment port 29D to the toner storage chamber 28 of the process cartridge 21.

Since the supply ports 111 of the vertically juxtaposed toner cartridges 100B and 100D are located offset from each other in the back and forth direction, the supply port 111 of the toner cartridge 100D does not overlap the cartridge casing 110B of the toner cartridge 100B when viewed from the up and down direction (vertical direction). That is, the supply port 111 of the toner cartridge 100D deviates to the back from a back wall face 112B of the cartridge casing 110B of the toner cartridge 100B as shown in FIG. 3.

Since the supply port 111 of the toner cartridge 100D does not overlap the cartridge casing 110B of the toner cartridge 100B when viewed from the up and down direction, an up and down width L1 of the conveying passage 50D (first horizontal section 51) can be made larger than a distance L2 between the adjacent toner cartridges 100B and 100D, as shown in FIG. 5.

In other words, since the supply port 111 of the toner cartridge 100D does not overlap the cartridge casing 110B of the toner cartridge 100B when viewed from the up and down direction, the distance L2 between the adjacent toner cartridges 100B and 100D can be made small even if the width L1 of the first horizontal section 51 is made large.

In addition, an outer periphery 132A of the drive gear 132 of the toner cartridge 100B is located below a top face 113B of the cartridge casing 110B (see FIG. 3).

In case of the conveying passage 50B shown in FIG. 1, it is desirable that a conveying member, such as an auger a spring auger, and a combination thereof, is also provided in a portion of the conveying passage 50B elongating in the back and forth direction. The second horizontal section 52 as shown in FIG. 5 may be provided with an auger in place of the spring auger 56.

The function and the effect of the described color laser printer 1 will be discussed.

The toner cartridges 100B and 100D (or 100A and 100C) are juxtaposed substantially in the vertical direction so that the supply ports 111 are offset from each other in the back and forth direction. Accordingly, the conveying passage 50 is ensured while the vertically adjacent toner cartridges 100B and 100D are disposed close to each other. Specifically, the up and down width L1 of the conveying passage 50D (first horizontal section 51) can be made larger than the distance L2 between the toner cartridges 100B and 100D, as shown in FIG. 5. Accordingly, while the size of the conveying passage 50 is ensured, the color laser printer 1 can be miniaturized in the up and down direction.

As the color laser printer 1 is miniaturized in the up and down direction, the upper space of the color laser printer 1 can be used effectively. Further, since the supply ports 111 of the toner cartridges 100B and 100D (or 100A and 100C) juxtaposed substantially in the vertical direction are offset from each other in the back and forth direction (the length direction of the toner cartridge 100), the left-right upsizing of the color laser printer 1 can be suppressed as compared with the case where the supply ports of the toner cartridges juxtaposed substantially in the vertical direction are offset from each other in the left-right direction (the width direction of the toner cartridge).

Since the toner cartridges 100B and 100D (or 100A and 100C) does not overlap each other when viewed from the left-right direction, the left-right upsizing of the color laser printer 1 can be suppressed as compared with the case where the toner cartridges are disposed so that the upper part of the toner cartridge located in the lower side and the lower part of the toner cartridge located in the upper side overlap when viewed from the left-right direction.

As shown in FIG. 2, since the toner cartridges 100A to 100D can be attached to and detached from the front (one side) of the main body casing 2, the upper space of the color laser printer 1 can be used effectively as compared with the case where the toner cartridge is attached to and detached from the top of the main body casing.

Since the toner cartridges 100B and 100D (or 100A and 100C) juxtaposed substantially in the vertical direction are disposed to overlap the image forming unit 4 when viewed from the left-right direction, the color laser printer 1 can be miniaturized in the up and down direction and the upper space of the color laser printer 1 can be used effectively as compared with the case where a plurality of toner cartridges are disposed above an image forming unit (for example, patent document 1).

Particularly in this embodiment, the lower toner cartridges 100A and 100B are disposed to overlap the exposure unit 10 when viewed from the left-right direction as shown in FIG. 4, and therefore the color laser printer 1 can be miniaturized in the up and down direction while the space in the main body casing 2 can be used effectively. That is, although the left-right dimension of the developing unit 20 having the photosensitive drum 24, etc., needs to be made wider than the image formation width, the left-right dimension of the exposure unit 10 can be made substantially equal to or smaller than the image formation width to provide an extra space in an image formation width direction.

Figure 6:
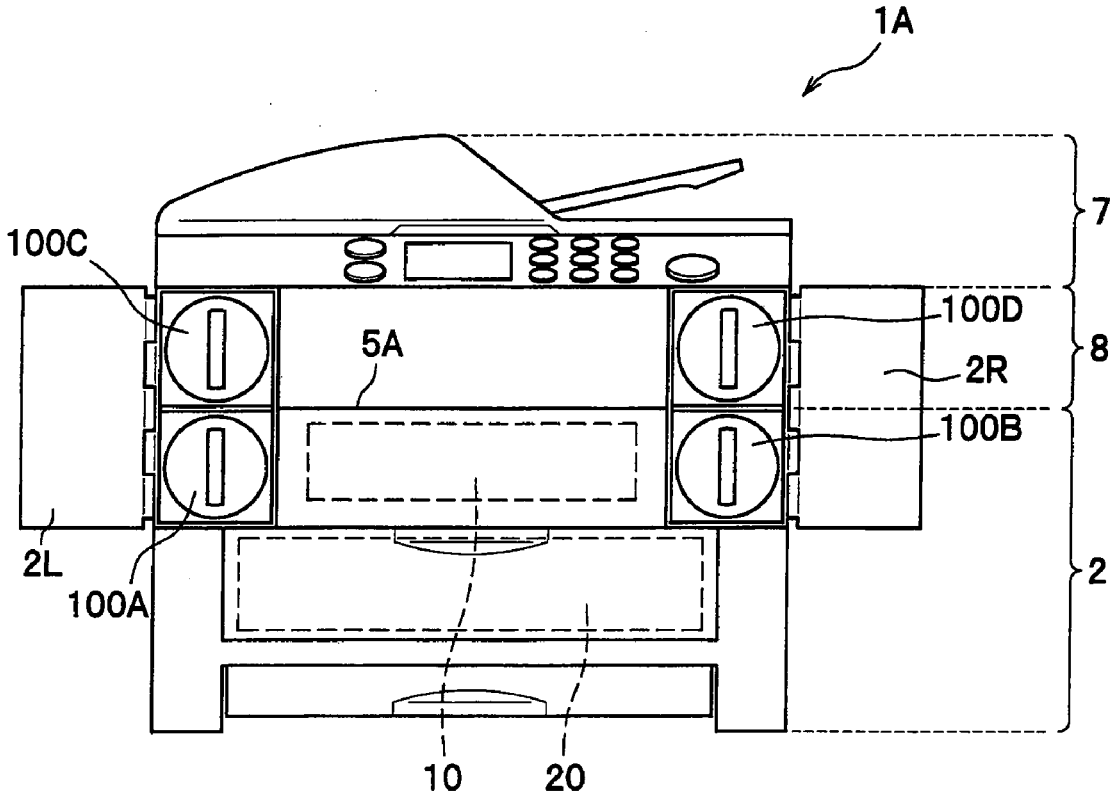
FIG. 6 is a front view of a color laser printer provided with a flatbed scanner as an example of an image read unit above the main body casing.

Since the upper toner cartridges 100C and 100D are disposed to overlap the sheet discharge tray 5A when viewed from the left-right direction, the inside of the main body casing 2 and the space above the main body casing 2 can be used effectively. As means for using the space above the main body casing 2 effectively, a flatbed scanner 7 as an example of an image read unit can be provided above the main body casing 2, for example, like a color laser printer 1A shown in FIG. 6. In this case, since the toner cartridges 100C and 100D can be disposed in a support member 8 provided between the main body casing 2 and the flatbed scanner 7 for supporting the flatbed scanner 7, the space in the support member 8 can be used effectively.

In the color laser printer 1 of the embodiment, the toner cartridges 100A to 100D are disposed so that the toner cartridges 100A to 100D elongates in the back and forth direction (side direction), namely, the toner cartridges 100A to 100D are disposed in the main body casing 2 in a state as a cylinder lies down substantially horizontally. Accordingly, the toner is stored in the cartridge without being deposited thick and to be easily agitated and conveyed. Therefore, the agitator 130 provided in each of the toner cartridges 100A to 100D can well agitate and convey the toner to the supply port 111.

Since the replenishment port 29 is located below the supply port 111, that is, lower in gravity direction than the supply port 111, the toner can be well conveyed from the supply port 111 to the replenishment port 29 through the conveying passage 50 using the gravity in addition to the conveying force of the auger 55 and the spring auger 56.

Since the color laser printer 1 of the embodiment is configured so that the length direction of the toner cartridges 100A to 100D is substantially coincident with in the attachment/detachment direction, the toner cartridges 100A to 100D can be attached or detached without interference with any other member. That is, as shown in FIG. 2, the toner cartridges 100A to 100D and the developing unit 20 (frame 22) can be disposed completely separately to avoid any interference of the attachment/detachment passages of the toner cartridges 100A to 100D with the attachment/detachment passage of the developing unit 20 (frame 22). Accordingly, the toner cartridges 100A to 100D and the process cartridges 21A to 21D can be replaced separately in any desired order, and therefore the operability of the color laser printer 1 can be improved.

Since the toner cartridges 100A to 100D are disposed so that the length direction of the toner cartridges 100A to 100D is substantially coincident with the attachment/detachment direction as shown in FIG. 2, the space (passage) required for attaching or detaching the toner cartridges 100A to 100D in the main body casing 2 can be minimized. Accordingly, the space in the main body casing 2 can be used effectively. Since the main body casing 2 can be miniaturized, the color laser printer 1 can be miniaturized.

As shown in FIG. 1, since the toner cartridges 100A to 100D are disposed so that the length direction of the toner cartridges 100A to 100D is substantially coincident with the back and forth direction, i.e. the direction in which the photosensitive drums 24 are arrayed, the capacity of each of the toner cartridges 100A to 100D can be increased. That is, the back and forth direction, i.e. the array direction of the photosensitive drums 24, is generally a longer direction of the main body casing 2 and therefore making the length direction of the toner cartridges 100A to 100D substantially coincident with the array direction can increase the dimensions of the toner cartridges 100A to 100D in the length direction. Accordingly, the space in the main body casing 2 can also be used effectively.

Further, the handle 120 is provided ahead of the toner cartridges 100A to 100D as shown in FIG. 4, thereby improving the operability during the attachment and detachment of the cartridges. Further, the supply ports 111 and the drive gears 132 are provided at the back of the toner cartridges 100A to 100D, namely, on the opposite side from the handle 120. Accordingly, soiling a user's hand by coming in contact with the supply port 111 or the drive gear 132 can be suppressed and the operability can be improved.

In the color laser printer 1 of the embodiment, the toner cartridges 100A to 100D are disposed above the developing unit 20 and the fixing unit 40 is disposed at the back of the developing unit 20 (see FIG. 1). That is, the toner cartridges 100A to 100D and the fixing unit 40 are offset from each other in the horizontal direction and the up and down direction. Accordingly, adverse effect on the toner in the toner cartridges 100A to 100D by heat generated in the fixing unit 40 can be suppressed.

A drive unit (not shown) for giving or transmitting a drive force to the photosensitive drums 24, various rollers, etc., an electrode of a heating member of the heating roller 41, and the like can be arranged in the lower space of the toner cartridges 100A to 100D in the main body casing 2. Accordingly, the space in the main body casing 2 can be used more effectively and the main body casing 2 can be miniaturized.

Although the embodiment of the invention has been described, it is to be understood that the invention is not limited to the embodiment described above. The specific configuration can be changed as required without departing from the spirit and the scope of the invention.

In the embodiment described above, the toner cartridges 100A to 100D are disposed two on each side with the image forming unit 4 interposed therebetween, but the invention is not limited to that configuration. The toner cartridges may be disposed three or more on each side to be juxtaposed substantially in the vertical direction. Further, the number of the toner cartridges may vary from one side to another, for example, such that one is disposed on one side of the image forming unit and three are disposed on the other side to be juxtaposed substantially in the vertical direction.

Figure 7:
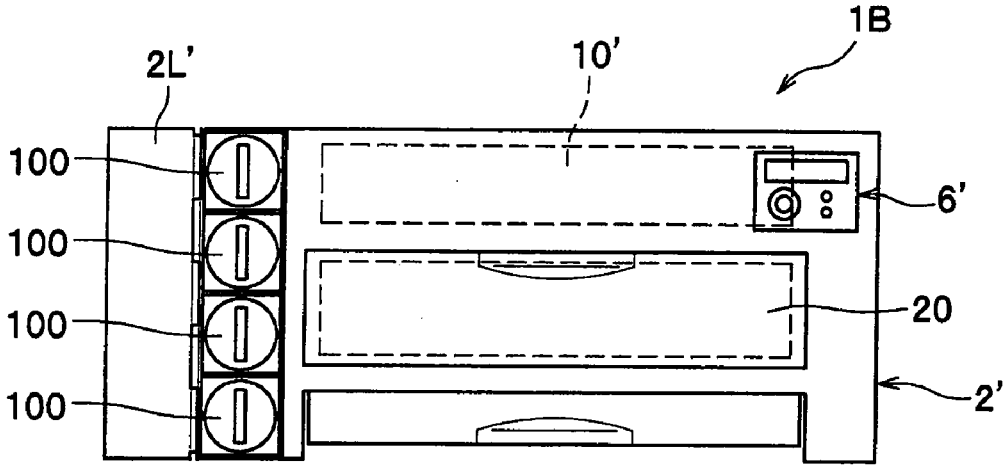
FIG. 7 is a front view to show a color laser printer as another example.

Further, all toner cartridges 100 may be disposed on one side of the image forming unit 4 to be juxtaposed substantially in the vertical direction as in a color laser printer 1B shown in FIG. 7. Accordingly, a toner conveying passage, etc., can be provided on one side of the image forming unit 4 and a drive section of a photosensitive body, etc., can be provided on the other side, so that the structure in a main body casing 2' can be simplified as a whole.

In the embodiment described above, the operation unit 6 (see FIG. 2) is provided on the front left of the top face of the main body casing 2, but the invention is not limited to that layout. That is, the operation unit of the invention may be disposed at any position if the operation unit can be operated by the user from one side of the main body casing (for example, from the front). That is, the operation unit can be disposed at any location as long as it is directed toward or operable from the one side of the main body casing. Of course, the operation unit can be disposed directly on the one side of the main body casing 2' like the operation unit 6' shown in FIG. 7.

In the embodiment described above, the process cartridge 21 mainly includes the photosensitive drum 24 and the developing roller 25, but the invention is not limited to that configuration. For example, the process cartridge 21 may include a first cartridge having a photosensitive drum (photosensitive member) and a second cartridge having a developing roller and detachably mountable to the first cartridge.

In the embodiment described above, the dimensions of the toner cartridges 100A to 100D in the length direction (back and forth direction) thereof are the same, but the invention is not limited to that configuration. The dimensions of the toner cartridges in the length direction thereof may vary. For example, the dimensions of the vertically juxtaposed toner cartridges may vary such that the back end parts of the toner cartridges are offset from each other in the back and forth direction and the front end parts thereof match with each other in the back and forth direction. This case, the capacity of a toner cartridge for storing black toner frequently used can be increased.

In the embodiment described above, the exposure unit 10 has the left-right dimension smaller than the developing unit 20 (frame 22), but the invention is not limited to that configuration. The invention can also be applied to an image formation apparatus including an exposure unit 10' and a developing unit 20' equal in the left-right dimension, for example, as shown in FIG. 7.

In the embodiment described above, the toner cartridges 100A to 100D are detachable from the front side of the main body casing 2, but the invention is not limited to that configuration. The toner cartridges 100A to 100D may be detachable from another side of the main body casing 2, for example, from the right or left side.

In the embodiment described above, the photosensitive drum 24 is adopted as an example of the photosensitive member, the handle 120 is adopted as an example of the gripper, the agitator 130 is adopted as an example of the conveying member, the drive gear 132 is adopted as an example of the drive input part, and the like, but the invention is not limited to those examples. That is, the material, structure, etc., can be changed as required without departing from the spirit and the scope of the invention. For example, an auger may be adopted as another example of the conveying member.

As discussed above, the present invention can provide, as one of illustrative, non-limiting embodiment, an image formation apparatus including a main body casing, a plurality of developer storage members for storing developers, and an image forming unit for forming an image on a record sheet with the developers supplied from the developer storage members. Each of the developer storage members is disposed in the casing to elongate in a back-and-forth direction and a developer supply port of the developer storage member is directed downward at a lower part of the developer storage member. At least two of the plurality of developer storage members are juxtaposed substantially in a vertical direction and the supply ports of the juxtaposed developer storage members are offset from each other in the length direction, i.e. the elongating direction, of the developer storage members.

According to the image formation apparatus, at least two of the developer storage members are juxtaposed substantially in the vertical direction and the support ports of the juxtaposed developer storage members are offset from each other in the length direction of the developer storage members. A developer passage from the supply port to the image forming unit can be ensured while the vertically juxtaposed developer storage members are disposed closer to each other. Accordingly, the apparatus can be miniaturized in the up and down direction (vertical direction). Since the apparatus can be miniaturized in the up and down direction, the upper space above the apparatus can be used effectively.

Since the supply ports of the vertically juxtaposed developer storage members are offset from each other in the length direction of the developer storage members, upsizing the image formation apparatus in the width direction (a shorter-side direction of a horizontal direction) of the developer storage members can be suppressed.

What is claimed is:

1. An image formation apparatus comprising:

a casing defining a first vertical direction, a second direction perpendicular to the first direction and a third direction perpendicular to both the first and second directions, the second and third directions being horizontal directions;

first and second image forming units; and first and second developer storage members, each having an developer supply port, the first and second developer storage members being disposed in the casing to be overlapping in the first direction and to extend in the second direction so that the developer supply ports of the first and second developer storage members are offset in the second direction, the developer supply ports configured to enable developer to be provided to the first and second image forming units, respectively.

2. The image formation apparatus as claimed in claim 1, wherein the first direction is coincident with a gravity direction, and the first and second developer storage members are disposed in the casing so that each of the developer supply port is located at a lower part of a corresponding one of the first and second developer storage members in the gravity direction and is directed downward.

3. The image formation apparatus as claimed in claim 2, each of the image forming units further comprising first and second replenishment ports, to which developers from the first and second developer storage members are to be supplied, respectively, wherein the first and second replenishment ports are respectively located lower than the supply ports of the first and second developer storage members in the first direction.

4. The image formation apparatus as claimed in claim 3, wherein each of the first and second developer storage members has a first end part where the developer supply port is provided and an second end part opposite from the first end part, wherein each of the first and second developer storage members is detachable from one side of the casing, and wherein, when the developer storage member is disposed in the casing, the second end part is located closer to the one side of the casing than the first end part is located.

5. The image formation apparatus as claimed in claim 4, further comprising first and second conveying passages, through which the first and second replenishment ports are respectively in communication with the supply ports of the first and second developer storage members disposed in the casing, wherein the first conveying passage has a width larger than a distance between the first and second storage members in the first direction and the first conveying passage at least in part overlap the second developer storage member when viewed from the second direction.

6. The image formation apparatus as claimed in claim 2, further comprising a record sheet discharge unit provided in an upper part of the casing, wherein at least one of the first and second developer storage members disposed in the casing overlaps the record sheet discharge unit when viewed from the third direction.

7. The image formation apparatus as claimed in claim 2, further comprising an image read unit provided above the casing and a support member provided between said casing and the image read unit and configured to support the image read unit on the casing, wherein at least one of the first and second developer storage members disposed in the casing is located in the support member.

8. The image formation apparatus as claimed in claim 1, wherein the first and second developer storage members are disposed in the casing so as not to overlap when viewed from at least one of the second and third directions.

9. The image formation apparatus as claimed in claim 1, wherein each of the first and second developer storage members is detachable from one side of the casing.

10. The image formation apparatus as claimed in claim 9, further comprising an operation section operable from the one side of the casing, wherein each of the first and second developer storage members is detachable substantially in the second direction.

11. The image formation apparatus as claimed in claim 9, wherein each of the first and second developer storage members has a conveying member configured to convey a stored developer to the supply port along a length of the developer storage member.

12. The image formation apparatus as claimed in claim 11, wherein each of the first and second developer storage members has a drive input part at a first end part thereof and a gripper at an opposite, second end part thereof, and wherein, when the developer storage member is disposed in the casing, the gripper is located closer to the one side of the casing than the drive input part is located.

13. The image formation apparatus as claimed in claim 12, wherein the supply port is disposed at the first end part of said developer storage member.

14. The image formation apparatus as claimed in claim 1, wherein the first and second developer storage members are disposed in the casing so that at least one of the first and second developer storage members overlaps the image forming units when viewed from the third direction.

15. The image formation apparatus as claimed in claim 14, wherein each of the image forming units comprises an exposure unit and a developing unit having a photosensitive member, wherein the exposure unit and the developing unit are juxtaposed substantially in the first direction, wherein the exposure unit is smaller than the developing unit in the third direction, and wherein the first and second developer storage members are disposed in the casing so that at least one the first and second developer storage members at least in part overlaps the exposure unit when viewed from the third direction.

16. The image formation apparatus as claimed in claim 15, wherein the developing unit has a plurality of the photosensitive members arrayed substantially in the second direction.

17. The image formation apparatus as claimed in claim 15, wherein the developing units are attached to and detached from one side of the casing through an attachment-detachment passage that does not intersect an attachment-detachment passage, through which the first and second developer storage members are attached to and detached from the one side of the casing.

18. The image formation apparatus as claimed in claim 14, further comprising a third developer storage member, wherein the third developer storage member is disposed in the casing so that the image forming units are at least in part located between the third developer storage member and each of the first and second developer storage members in the third direction.

19. The image formation apparatus as claimed in claim 14, further comprising one or more additional developer storage members, wherein the first and second developer storage members and the one or more additional developer storage members are all disposed in the casing at one side of the image forming units in the third direction.

20. The image forming apparatus as claimed in claim 1, wherein each of the image forming units is configured to transfer, on a recording medium, developer supplied from the corresponding first or second developer storage member.

* * * * *